US010121575B2

(12) United States Patent
Lee

(10) Patent No.: US 10,121,575 B2
(45) Date of Patent: Nov. 6, 2018

(54) THIN FILM RESISTOR

(71) Applicant: NATIONAL PINGTUNG UNIVERSITY OF SCIENCE & TECHNOLOGY, Pingtung (TW)

(72) Inventor: Ying-Chieh Lee, Pingtung (TW)

(73) Assignee: NATIONAL PINGTUNG UNIVERSITY OF SCIENCE & TECHNOLOGY, Pingtung County (TW)

( * ) Notice: Subject to any disclaimer, the term of this patent is extended or adjusted under 35 U.S.C. 154(b) by 259 days.

(21) Appl. No.: 15/346,567

(22) Filed: Nov. 8, 2016

(65) Prior Publication Data

US 2018/0040396 A1 Feb. 8, 2018

(30) Foreign Application Priority Data

Aug. 3, 2016 (TW) ..... 105124680 A

(51) Int. Cl.

| | |
|---|---|
| ***C22C 19/05*** | (2006.01) |
| ***H01C 7/00*** | (2006.01) |
| ***H01C 17/12*** | (2006.01) |
| ***H01C 7/06*** | (2006.01) |
| ***H01C 17/075*** | (2006.01) |

(52) U.S. Cl.

CPC ..... *H01C 7/006* (2013.01); *C22C 19/05* (2013.01); *H01C 7/06* (2013.01); *H01C 17/075* (2013.01); *H01C 17/12* (2013.01)

(58) Field of Classification Search

CPC ..... C22C 19/05; H01C 17/075; H01C 17/12; H01C 7/006; H01C 7/06

See application file for complete search history.

(56) References Cited

U.S. PATENT DOCUMENTS

| | | | | |
|---|---|---|---|---|
| 4,824,481 | A * | 4/1989 | Chatterjee | B22F 3/14 204/292 |
| 5,304,345 | A * | 4/1994 | Fujitani | H01M 4/383 420/455 |
| 6,303,218 | B1 | 10/2001 | Kamiguchi et al. | |
| 6,593,031 | B1 * | 7/2003 | Onishi | H01M 4/364 252/182.1 |
| 2007/0069192 | A1 | 3/2007 | Odagawa et al. | |

FOREIGN PATENT DOCUMENTS

JP 09025529 A * 1/1997

* cited by examiner

*Primary Examiner* — Ngoc-Yen Nguyen
(74) *Attorney, Agent, or Firm* — WPAT, PC

(57) ABSTRACT

A thin film resistor includes 38-60 at.% of nickel, 10-25 at.% of chromium, 3-10 at.% of manganese, 4-18 at.% of yttrium, and 1-36 at.% of dysprosium. The thin film resistor can greatly increase the resistivity with a low temperature coefficient of resistance to broaden the applications of the thin film resistor.

10 Claims, 4 Drawing Sheets

THIN FILM RESISTOR

CROSS REFERENCE TO RELATED APPLICATIONS

The application claims the benefit of Taiwan application serial No. 105124680, filed Aug. 03, 2016, the subject matter of which is incorporated herein by reference.

BACKGROUND

1. Technical Field

The present disclosure relates to a resistor and, more particularly, to a thin film resistor.

2. Description of the Related Art

Resistors are a type of passive components and can be classified into two types, one of which is a thick film resistor, and the other one is a thin film resistor. Thick film resistor is generally used in consumer electronics having lower requirements in the accuracy and tolerance of resistance. Thin film resistor has relatively high accuracy along with improvement in the preparation methods and materials and can, thus, be used in delicate instruments, such as medical instruments, industrial computers, and automobiles, thereby having a high economic potential.

The ingredients of a thin film resistor are generally the decisive factor of the applications, and the temperature coefficient of resistance (TCR) and the resistivity of the thin film resistor are especially the indexes of the applications. An excellent thin film resistor should have a low TCR, such that when the thin film resistor is assembled to form a chip resistor or an electronic device, the volume can be reduced while having high operating stability.

A conventional thin film resistor includes nickel-chromium alloy or nickel-chromium-manganese alloy and has a low TCR, such that the conventional thin film resistor maintains excellent stability even after a temperature change. However, when the conventional thin film resistor with the low TCR often has a low resistivity due to limitations by the material of the conventional thin film resistor. As a result, the applications of the conventional thin film resistor with lower resistance are limited due to the resistivity of deposited film compositions is low. So, the conventional thin film resistor cannot be applied in the chips requiring high resistance.

Thus, a need exists for a novel thin film resistor to solve the problems resulting from the failure of reaching a high resistivity with a low TCR at the same time.

BRIEF SUMMARY

To solve the above problems, a thin film resistor with a low TCR (in a range between +50 ppm/° C. and −50 ppm/° C.) and an increased resistivity is provided.

The thin film resistor includes 38-60 at.% of nickel, 10-25 at.% of chromium, 3-10 at.% of manganese, 4-18 at.% of yttrium, and 1-36 at.% of at least one of the lanthanide elements.

Due to the ingredients (nickel, chromium, manganese, yttrium, and lanthanide elements) and the specific ratio (38-60 at.% of nickel, 10-25 at.% of chromium, 3-10 at.% of manganese, 4-18 at.% of yttrium, and 1-36 at.% of at least one of the lanthanide elements), the resistivity of the thin film resistor can be increased with a low TCR, broadening the applications of the thin film resistor.

The thin film resistor can include 40.4-58.5 at.% of nickel, 12.5-21.6 at.% of chromium, 5.2-7.8 at.% of manganese, 6.1-15.5 at.% of yttrium, and 3.7-33.1 at.% of at least one of the lanthanide elements, such that the thin film resistor with a low TCR has a high resistivity.

The thin film resistor can include 58.5 at.% of nickel, 21.6 at.% of chromium, 7.5 at.% of manganese, 8.7 at.% of yttrium, and 3.7 at.% of dysprosium; 44.6 at.% of nickel, 16.2 at.% of chromium, 5.2 at.% of manganese, 15.5 at.% of yttrium, and 18.5 at.% of dysprosium; 42.9 at.% of nickel, 15.2 at.% of chromium, 6.2 at.% of manganese, 9.5 at.% of yttrium, and 26.2 at.% of dysprosium; or 41.0 at.% of nickel, 14.3 at.% of chromium, 5.5 at.% of manganese, 6.1 at.% of yttrium, and 33.1 at.% of dysprosium. Thus, the composition of the thin film resistor can be adjusted according to various needs of different resistivities.

The thin film resistor can include 54.8 at.% of nickel, 19.4 at.% of chromium, 7.8 at.% of manganese, 12.9 at.% of yttrium, and 5.1 at.% of terbium; 46.6 at.% of nickel, 16.9 at.% of chromium, 8.3 at.% of manganese, 10.1 at.% of yttrium, and 18.1 at.% of terbium; 42.9 at.% of nickel, 15.1 at.% of chromium, 6.1 at.% of manganese, 10.8 at.% of yttrium, and 25.1 at.% of terbium; or 40.4 at.% of nickel, 12.5 at.% of chromium, 5.4 at.% of manganese, 9.2 at.% of yttrium, and 32.5 at.% of terbium. Thus, the composition of the thin film resistor can be adjusted according to various needs of different resistivities.

The above objective and other objectives, features, and advantages of the present disclosure will become clearer in light of the following detailed description of illustrative embodiments of the present disclosure described in connection with the drawings.

DETAILED DESCRIPTION

A thin film resistor according to the present disclosure includes 38-60 at.% of nickel, 10-25 at.% of chromium, 3-10 at.% of manganese, 4-18 at.% of yttrium, and 1-36 at.% of at least one of the lanthanide elements. The lanthanide elements includes lanthanide (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), and lutetium (Lu), which can be appreciated by one having ordinary skill in the art. Specifically, the thin film resistor can include only one or several of the lanthanide elements to achieve 1-36 at.%. By adding nickel, chromium, and manganese at an appropriate ratio, the thin film resistor can have a low TCR. By adding the yttrium and the lanthanide elements, the thin film resistor can have a resistivity higher than that of a conventional Ni—Cr—Mn thin film resistor.

The thin film resistor can be produced by any conventional method for producing thin film resistors, such as vacuum evaporation or sputtering (including D.C. magnetron sputtering or radio frequency magnetron sputtering). In an example according to the present disclosure, D.C. magnetron sputtering is used, metal meeting the composition of the thin film resistor is used as the target, and sputtering is conducted in a vacuum by using a D.C. current with a fixed power which can be set in a range of 10-75W. After sputtering, annealing is conducted for 4 hours at 300° C. Thus, a thin film resistor of a thickness smaller than 300 nm is deposited on a substrate. The thickness of the thin film can be adjusted according to the time and power of sputtering. The method for producing the thin film resistor and the thickness of the thin film resistor are not limited in the present disclosure.

Since the thin film resistor according to the present disclosure includes nickel, chromium, yttrium, and the lanthanide elements and since these metal ingredients have a specific ratio therebetween, the thin film resistor with a low TCR can have a resistivity higher than that of a conventional Ni—Cr—Mn thin film resistor. Generally, a low TCR is in a range between +50 ppm/° C. and −50 ppm/° C.

To prove the thin film resistor according to the present disclosure indeed have a high resistivity with a low TCR at the same time, the following experiment was conducted.

Figure 1:
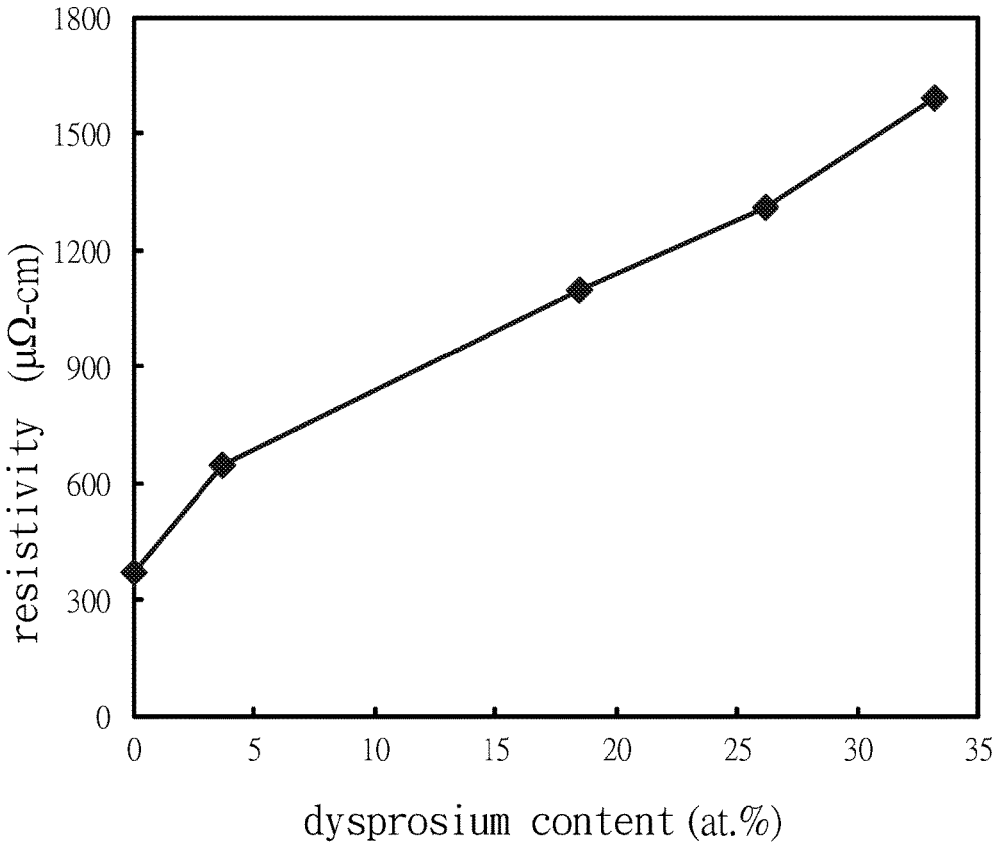
FIG. 1 is a diagram illustrating the relationship between the resistivity and the dysprosium content of the thin film resistor according to the present disclosure and of a conventional thin film resistor.

(A) Thin Film Resistors Including Ni, Cr, Mn, Yt, and Dy According to the Present Disclosure In this experiment, a conventional Ni—Cr—Mn thin film resistor was used as a comparative group (group A0), and four-point probe technique was used to measure the resistivity of the comparative group and the resistivity the thin film resistor according to the present disclosure. In this experiment, the thin film resistors according to the present disclosure were divided into several groups A1, A2, A3, and A4. The ratio of the compositions of each group was shown in Table 1 below, and the measurement result of the resistivity of each group was shown in FIG. 1. The atom percent of each group was obtained by energy-dispersive x-ray spectroscopy (EDS).

TABLE 1

List of compositions of groups A0-A4

| | nickel (at. %) | chromium (at. %) | manganese (at. %) | yttrium (at. %) | dysprosium (at. %) |
|---|---|---|---|---|---|
| group A0 | 55.0 | 33.0 | 12.0 | 0 | 0 |
| group A1 | 58.5 | 21.6 | 7.5 | 8.7 | 3.7 |
| group A2 | 44.6 | 16.2 | 5.2 | 15.5 | 18.5 |
| group A3 | 42.9 | 15.2 | 6.2 | 9.5 | 26.2 |
| group A4 | 41.0 | 14.3 | 5.5 | 6.1 | 33.1 |

The measurement result of resistivities: the resistivity of group A0 was 369 μΩ-cm, the resistivity of group A1 was 646 μΩ-cm, the resistivity of group A2 was 1096 μΩ-cm, the resistivity of group A3 was 310 μΩ-cm, and the resistivity of group A4 was 1590 μΩ-cm. As can be seen from FIG. 1, the resistivity of each of groups A1-A4 was obviously higher than the resistivity of group A0. Namely, the resistivity of the thin film resistor according to the present disclosure was higher than the conventional Ni—Cr—Mn thin film resistor. Furthermore, according to the measurement result of the resistivities of groups A1-A4, the resistivity was increased when the atom percent of the dysprosium increased from 3.7% to 33.1%.

Figure 2:
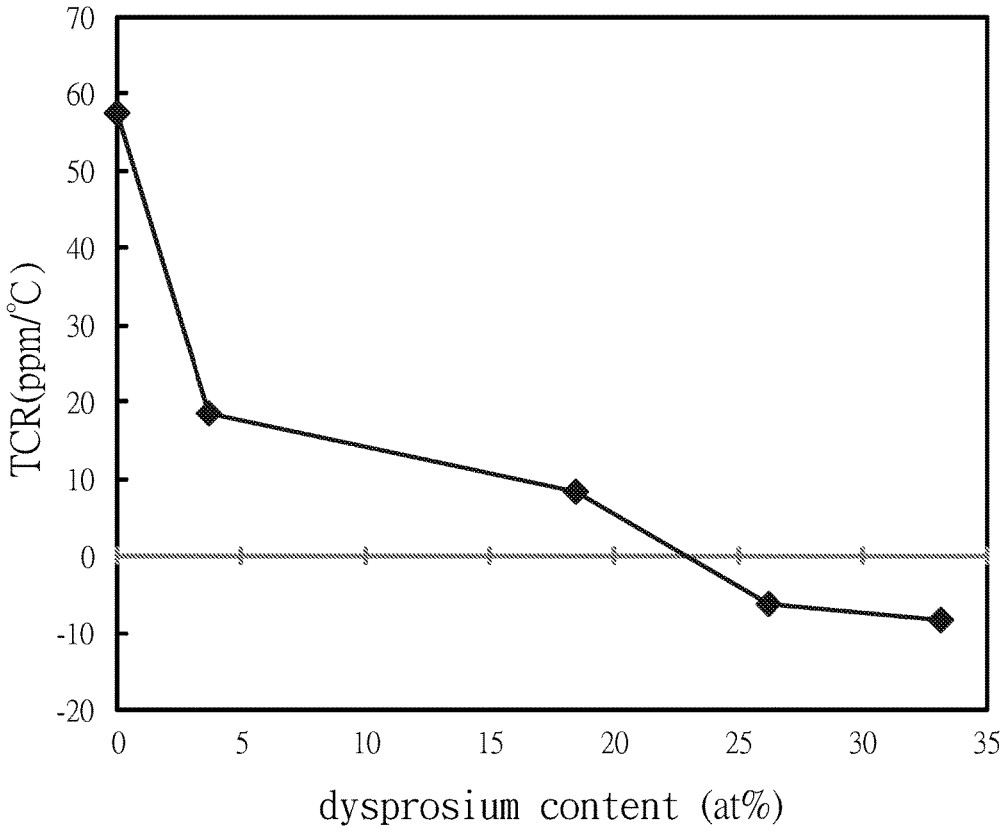
FIG. 2 is a diagram illustrating the relationship between the temperature coefficient of resistance and the dysprosium content of the thin film resistor according to the present disclosure and of the conventional thin film resistor.

The average TCR of each group A0, A1, A2, A3, and A4 was measured. Specifically, each group was fixed on a jig and was measured simultaneously to obtain five temperature coefficients of resistance, and the average value was calculated. FIG. 2 shows the relationship between the dysprosium content and the TCR.

The measurement result of TCR: the TCR of group A0 was 57.5 ppm/° C., the TCR of group A1 was 18.5 ppm/° C., the TCR of group A2 was 8.3 ppm/° C., the TCR of group A3 was −6.2 ppm/° C., and the TCR of group A4 was −8.2 ppm/° C. According to the result of this experiment, the temperature coefficients of resistance of groups A1-A4 according to the present disclosure were between +50 ppm/° C. and −50 ppm/° C., which were in the range of low TCR.

Figure 3:
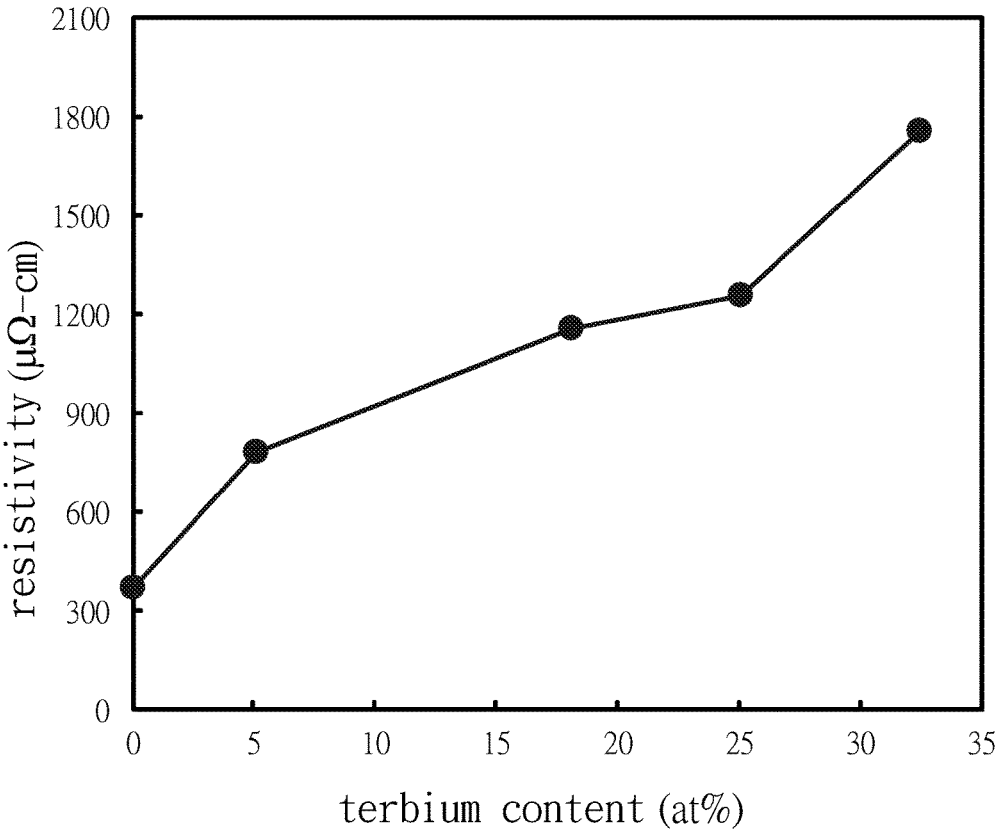
FIG. 3 is a diagram illustrating the relationship between the resistivity and the terbium content of the thin film resistor according to the present disclosure and of the conventional thin film resistor.

(B) Thin Film Resistors Including Ni, Cr, Mn, Yt, and Tb According to the Present Disclosure In this experiment, a conventional thin film resistor identical to group A0 was used as a comparative group (group B0), and the methods for measuring the resistivity and for analyzing the atom percent were the same as those used in experiment (A). In this experiment, the thin film resistors according to the present disclosure were divided into several groups B1, B2, B3, and B4. The ratio of the compositions of each group was shown in Table 2 below, and the measurement result of the resistivity of each group was shown in FIG. 3.

TABLE 2

List of compositions of groups A0-A4

| | nickel (at. %) | chromium (at. %) | manganese (at. %) | yttrium (at. %) | dysprosium (at. %) |
|---|---|---|---|---|---|
| group B0 | 55.0 | 33.0 | 12.0 | 0 | 0 |
| group B1 | 54.8 | 19.4 | 7.8 | 12.9 | 5.1 |
| group B2 | 46.6 | 16.9 | 8.3 | 10.1 | 18.1 |
| group B3 | 42.9 | 15.1 | 6.1 | 10.8 | 25.1 |
| group B4 | 40.4 | 12.5 | 5.4 | 9.2 | 32.5 |

The measurement result of resistivities: the resistivity of group B0 was 369 μΩ-cm, the resistivity of group B1 was 785 μΩ-cm, the resistivity of group B2 was 1155 μΩ-cm, the resistivity of group B3 was 1259 μΩ-cm, and the resistivity of group B4 was 1754 μΩ-cm. As can be seen from FIG. 3, the resistivity of each of groups B1-B4 was obviously higher than the resistivity of group B0. Namely, the resistivity of the thin film resistor according to the present disclosure was higher than the conventional Ni—Cr—Mn thin film resistor. Furthermore, according to the measurement result of the resistivities of groups B1-B4, the resistivity was increased when the atom percent of the dysprosium increased from 5.1% to 32.5%.

Figure 4:
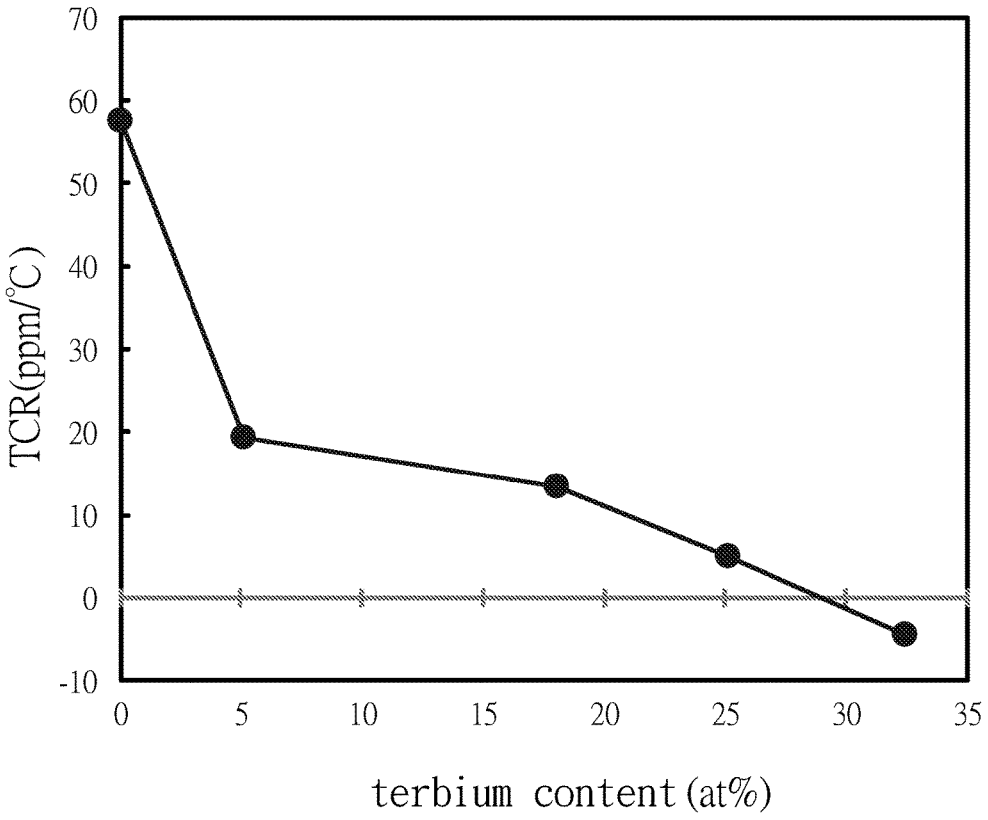
FIG. 4 is a diagram illustrating the relationship between the temperature coefficient of resistance and the terbium content of the thin film resistor according to the present disclosure and of the conventional thin film resistor.

The temperature coefficients of resistance of groups B0-B4 were measured by the same method used in experiment (A). FIG. 4 shows the relationship between the terbium content and the TCR. The measurement result of TCR: the TCR of group B0 was 57.5 ppm/° C., the TCR of group B1 was 19.4 ppm/° C., the TCR of group B2 was 13.4 ppm/° C., the TCR of group B3 was 5.0 ppm/° C., and the TCR of group B4 was −4.5 ppm/° C. According to the result of this experiment, the temperature coefficients of resistance of groups B1-B4 according to the present disclosure were between +50 ppm/° C. and −50 ppm/° C., which were in the range of low TCR.

In view of the above experiment results, no matter the lanthanide elements added is dysprosium or terbium, the thin film resistor with a low TCR according to the present disclosure has a resistivity higher than that of the conventional thin film resistor.

In view of the foregoing, due to the ingredients (nickel, chromium, manganese, yttrium, and lanthanide elements) and the specific ratio (38-60 at.% of nickel, 10-25 at.% of chromium, 3-10 at.% of manganese, 4-18 at.% of yttrium, and 1-36 at.% of at least one of the lanthanide elements), the resistivity of the thin film resistor according to the present disclosure can be increased at a low TCR, broadening the applications of the thin film resistor.

Thus since the disclosure disclosed herein may be embodied in other specific forms without departing from the spirit or general characteristics thereof, some of which forms have been indicated, the embodiments described herein are to be considered in all respects illustrative and not restrictive. The scope of the disclosure is to be indicated by the appended claims, rather than by the foregoing description, and all changes which come within the meaning and range of equivalency of the claims are intended to be embraced therein.

What is claimed is:

1. A thin film resistor comprising 38-60 at.% of nickel, 10-25 at.% of chromium, 3-10 at.% of manganese, 4-18 at.% of yttrium, and 1-36 at.% of at least one of lanthanide elements.

2. The thin film resistor as claimed in claim 1, wherein the thin film resistor comprises 40.4-58.5 at.% of nickel, 12.5-21.6 at.% of chromium, 5.2-7.8 at.% of manganese, 6.1-15.5 at.% of yttrium, and 3.7-33.1 at.% of at least one of the lanthanide elements.

3. The thin film resistor as claimed in claim 2, wherein the thin film resistor comprises 58.5 at.% of nickel, 21.6 at.% of chromium, 7.5 at.% of manganese, 8.7 at.% of yttrium, and 3.7 at.% of dysprosium.

4. The thin film resistor as claimed in claim 2, wherein the thin film resistor comprises 44.6 at.% of nickel, 16.2 at.% of chromium, 5.2 at.% of manganese, 15.5 at.% of yttrium, and 18.5 at.% of dysprosium.

5. The thin film resistor as claimed in claim 2, wherein the thin film resistor comprises 42.9 at.% of nickel, 15.2 at.% of chromium, 6.2 at.% of manganese, 9.5 at.% of yttrium, and 26.2 at.% of dysprosium.

6. The thin film resistor as claimed in claim 2, wherein the thin film resistor comprises 41.0 at.% of nickel, 14.3 at.% of chromium, 5.5 at.% of manganese, 6.1 at.% of yttrium, and 33.1 at.% of dysprosium.

7. The thin film resistor as claimed in claim 2, wherein the thin film resistor comprises 54.8 at.% of nickel, 19.4 at.% of chromium, 7.8 at.% of manganese, 12.9 at.% of yttrium, and 5.1 at.% of terbium.

8. The thin film resistor as claimed in claim 2, wherein the thin film resistor comprises 46.6 at.% of nickel, 16.9 at.% of chromium, 8.3 at.% of manganese, 10.1 at.% of yttrium, and 18.1 at.% of terbium.

9. The thin film resistor as claimed in claim 2, wherein the thin film resistor comprises 42.9 at.% of nickel, 15.1 at.% of chromium, 6.1 at.% of manganese, 10.8 at.% of yttrium, and 25.1 at.% of terbium.

10. The thin film resistor as claimed in claim 2, wherein the thin film resistor comprises 40.4 at.% of nickel, 12.5 at.% of chromium, 5.4 at.% of manganese, 9.2 at.% of yttrium, and 32.5 at.% of terbium.

* * * * *